US008496565B2

(12) United States Patent
Rothacker

(10) Patent No.: US 8,496,565 B2
(45) Date of Patent: Jul. 30, 2013

(54) METHOD AND APPARATUS FOR INCREASING GRIP STRENGTH

(76) Inventor: Alexander M. Rothacker, Wildwood, IL (US)

( * ) Notice: Subject to any disclaimer, the term of this patent is extended or adjusted under 35 U.S.C. 154(b) by 181 days.

(21) Appl. No.: 13/006,407

(22) Filed: Jan. 13, 2011

(65) Prior Publication Data

US 2012/0184415 A1 Jul. 19, 2012

(51) Int. Cl.
*A63B 21/00* (2006.01)

(52) U.S. Cl.
USPC ..... 482/49; 482/108; 482/109

(58) Field of Classification Search
USPC ..... 482/49, 50, 108, 109, 44, 45
See application file for complete search history.

(56) References Cited

U.S. PATENT DOCUMENTS

| | | | | |
|---|---|---|---|---|
| 4,840,370 | A * | 6/1989 | Biddlecombe | 482/49 |
| 6,663,579 | B2 * | 12/2003 | Eikanas | 601/40 |
| 6,770,011 | B1 * | 8/2004 | Hinds | 482/44 |
| 8,092,411 | B2 * | 1/2012 | Betcher | 602/21 |

OTHER PUBLICATIONS

"How to Get Crushing Grip Strength," eHow (2007). Retrieved from the Internet on Jan. 10, 2011: URL:http://www.ehow.com/how_2136042_crushing-grip-strength.html.

"How To's: How to Improve Your Grip Strength," Real Weight Training (2011). Retrieved from the Internet on Jan. 10, 2011: URL:http://www.realweighttraining.com/how-tos-how-to-improve-your-grip-strength/.

* cited by examiner

*Primary Examiner* — Jerome W Donnelly
(74) *Attorney, Agent, or Firm* — Marshall, Gerstein & Borun LLP

(57) ABSTRACT

In accordance with an embodiment of the disclosure, a method of increasing grip strength, includes gripping with one hand a weighted block having first and second side gripping surfaces such that the fingers and the thumb of the hand are disposed on the first and second side gripping surfaces, respectively, the fingers and the thumb extending substantially straight along the first and second side surfaces, respectively, and holding the weighted block such that an arm connected to the hand is extended substantially straight along a side of a user and the fingers and thumb are disposed substantially parallel to the side of the user. The weighted block has a width of about 1.75 inches to 3 inches.

27 Claims, 3 Drawing Sheets

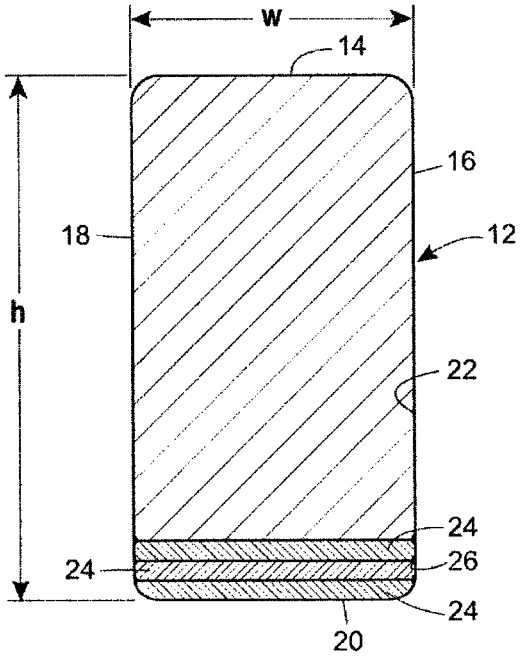
FIG. 2
FIG. 3
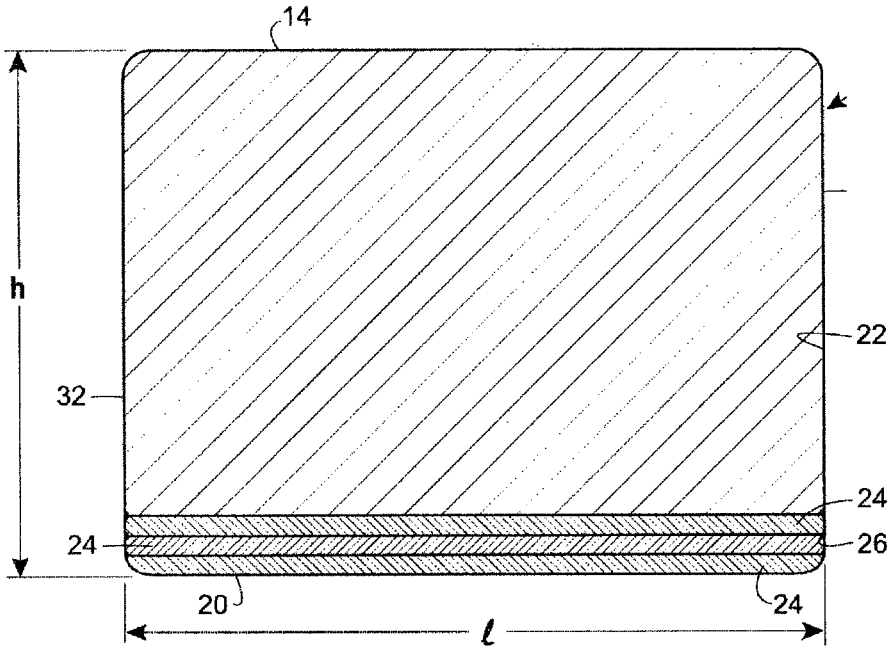

METHOD AND APPARATUS FOR INCREASING GRIP STRENGTH

BACKGROUND

1. Field of the Disclosure

The disclosure is generally related to a method and weighted block for increasing grip strength, and, more particularly, to a method and weighted block designed to allow for strengthening of the grip without harmfully straining the user.

2. Brief Description of Related Technology

Pinch strength is generally defined as the ability of a person to pinch weight between their fingers and their thumb. Improving pinch strength can help to alleviate and/or improve various hand ailments, such as, for example, carpal tunnel syndrome. Improved pinch strength and other aspects of grip strength can also beneficially help to improve various aspects of physical performance, particularly for athletes where grip strength and pinch strength are important, and treat and prevent the onset of repetitive strain hand-related injuries.

Many of the currently available devices and methods for improving grip and pinch strength do not provide a user with a suitable tool for maintaining a natural and strain-free grip during the exercise. Accordingly, such conventional devices and methods can detrimentally cause pain and/or injury to the user.

SUMMARY

In accordance with an embodiment of the disclosure, a method of increasing grip strength, includes gripping with one hand a weighted block having first and second side gripping surfaces such that the fingers and the thumb of the hand are disposed on the first and second side gripping surfaces, respectively, the fingers and the thumb extending substantially straight along the first and second side surfaces, respectively, and holding the weighted block such that an arm connected to the hand is extended substantially straight along a side of a user and the fingers and thumb are disposed substantially parallel to the side of the user. The weighted block has a width of about 1.75 inches to 3 inches.

In accordance with an embodiment of the disclosure, a weighted block for improving grip strength of a user includes an outer casing comprising first and second side gripping surfaces and top and bottom surfaces extending between and connecting the first and second side gripping surfaces. The weighted block further includes one or more weighted plates disposed in an inner portion of the outer casing, said weighted plates being disposed on or above the bottom surface. The outer casing has a width of about 1.75 inches to about 3 inches.

In accordance with another embodiment of the disclosure, a weighted block for improving grip strength of a user includes an outer casing comprising first and second side gripping surfaces, top and bottom surfaces extending between and connecting the first and second side gripping surfaces, and first and second end surfaces extending between and connecting the top and bottom surfaces and the first and second gripping surfaces, at least one of the surfaces being adapted to open and thereby allow access to an inner portion of the outer casing. The weighted block further includes one or more weighted plates removably disposed in the inner portion of the outer casing, said weighted plates being disposed on or above the bottom surface.

BRIEF DESCRIPTION OF THE DRAWINGS

FIG. 2 is across-sectional end view of the weighted block of FIG. 1 taken through line A-A;

FIG. 3 is a cross-sectional side view of the weighted block of FIG. 1 taken through line B-B.

DETAILED DESCRIPTION

Disclosed herein is a weighted block for improving grip and forearm strength and methods of using the weighted block. The weighted block is designed to engage and work the chain of muscles from the hand to the trapezoid muscle, including the hand muscles, the forearm muscles, the triceps, the shoulder, the lattissium dorsi, and part of the pectoral muscles. Working of the entire chain of muscles from the hand to the trapezoid muscles allows the muscles to be trained to work in sequence with the forearm muscles and the hand. Advantageously, the weighted block is designed so that the weight of the block pulls downward on the muscles separating the joints between the hand and the forearm, the forearm and the upper arm, and the upper arm and the shoulder. Separation of the joints can aid in healing of joint and muscular pain, as opposed to conventional devices and methods for improving grip strength that put compressive strain on the joints. In accordance with embodiments of the disclosure, methods of increasing grip strength using the weighted block can improve the strength of the extender muscles (a group of twelve muscles located between the fingers and the elbow) and the abductor muscle in the thumb, thereby improving the grip and forearm strength of the user. In particular, use of the weighted block can help improve the pinch strength of the user. In another embodiment, the weighted block can also be used in methods that strengthen the muscles that control supination and pronation of the forearm.

The methods of using the weighted block disclosed herein can be beneficial to anyone desirous of improving their grip strength and, in particular, their pinch strength. For example, the weighted block can help numerous athletes, whether professional or recreational, such as basketball players, football players, baseball players, pole vaulters, polo players, motocross racers, tennis players, and golfers improve their grip strength to improve various aspects of their physical performance. The methods disclosed herein can also beneficially aid in the treatment and prevention of carpal tunnel syndrome and/or rehabilitation after surgery to treat carpal tunnel syndrome and other similar repetitive strain hand-related ailments. Carpal tunnel syndrome can be caused or exacerbated by a lack of power between the fingers and the thumb (i.e., a lack of pinch strength). The weighted block and methods of using the same can help individuals improve their strength between the fingers and the thumb, without harmfully straining the joints and muscles of the hand and arm.

The Weighted Block

Figure 1:
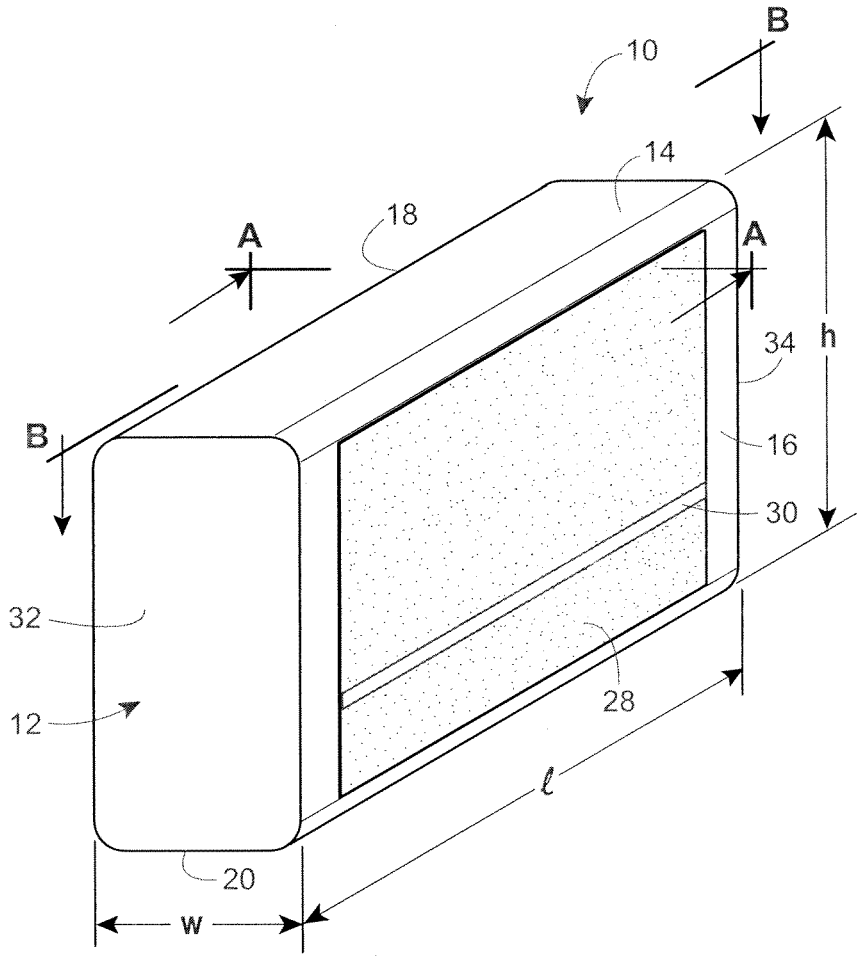
FIG. 1 is a perspective view of a weighted block in accordance with an embodiment of the disclosure.

Referring to FIG. 1, the weighted block 10 generally includes an outer casing 12 and one or more weighted plates 24 disposed in an interior 22 of the outer casing. The weighted block 10 and consequently the outer casing 12 can have any suitable shape that allows the user to form a natural grip when holding the weighted block 10. For example, the weighted block 10 can have a generally rectangular shape with two opposed side gripping surfaces 16, 18 that are gripped by the user's fingers and thumb, respectively. The weighted block 10 also includes a top surface 14 and a bottom surface 20. As illustrated, the weighted block 10 also includes two end surfaces 32, 34, but these are not necessary to provide a weighted block 10 in accordance with the invention. For example, in various embodiments of the disclosure, the weighted block 10 can remain open on one or both of the end regions. The top and bottom surfaces 14, 20 extend between and connect the two opposed side gripping surfaces 16, 18. Similarly, the two end surfaces 32, 34, when present, extend between and connect the top and bottom surfaces 14, 20 and extend between and connect the two opposed side gripping surfaces 16, 18. The user generally grips the weighted block 10 over the top surface 14. The top surface 14 and/or the bottom surface 20 can have squared, rounded, or chamfered edges (or corners). A top surface 14 having squared edges can beneficially facilitate proper positioning of the fingers when gripping the weighted block 10. In this respect, squared top surface edges can facilitate positioning of the user's thumb to extend straight and remain in a locked position while gripping the weighted block 10 as described in further detail below. In turn, this allows the user to utilize the full strength of the thumb without putting significant stress on the thumb joint.

Figure 4:
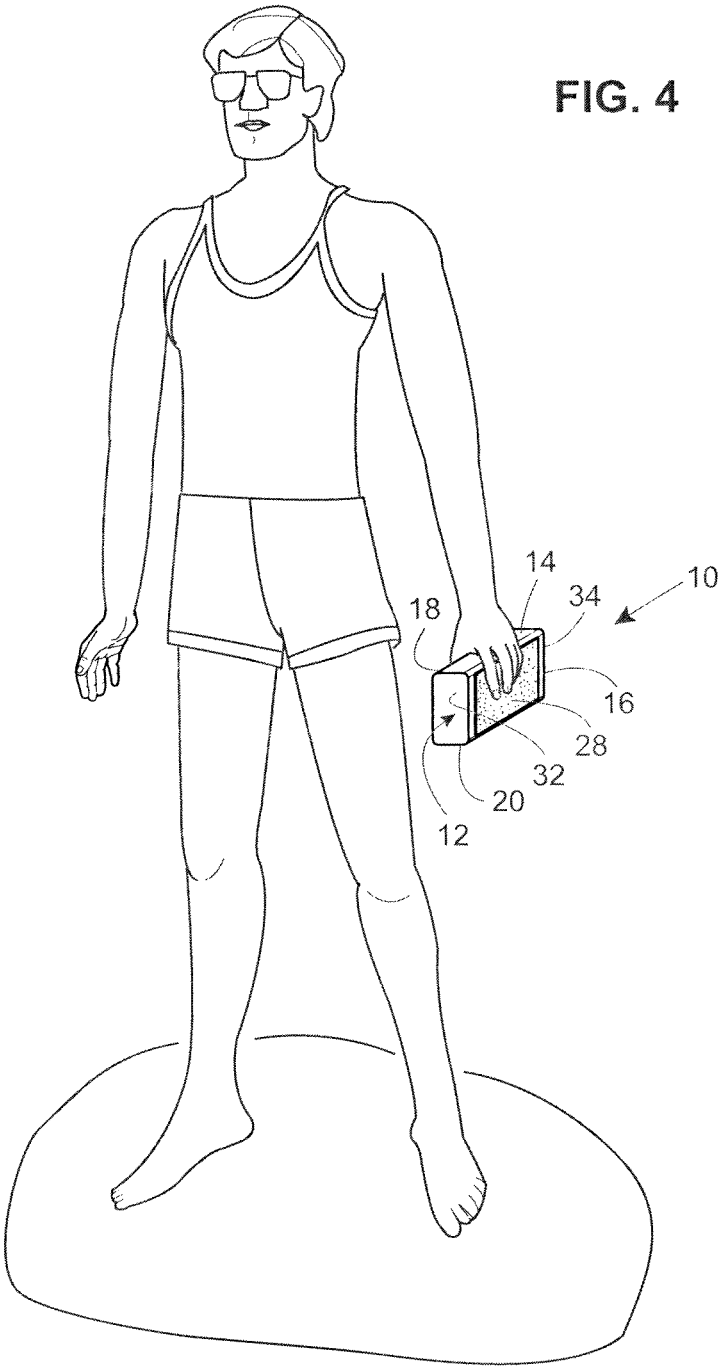
FIG. 4 is a schematic illustration of using a weighted block to improve grip strength in accordance with an embodiment of the disclosure.

The average human hand has a distance between the thumb knuckle and the index finger knuckle of about 2 inches. Referring to FIGS. 1 and 4, in order to fit comfortably within the hand of the average user and to prevent strain when using the weighed block 10, the weighted block 10 can have a width w such that substantially all of the user's fingers and thumb, from the knuckles down, extend along the side gripping surfaces 16, 18 of the weighted block 10. For example, the weighted block 10 can have a width w of about 1 inch to about 3 inches, about 1.75 inches to about 3 inches, about 1.75 inches to about 2.75 inches, and/or about 1.5 inches to about 2.5 inches. Other suitable widths w include, for example, about 1, 1.25, 1.5, 1.75, 2, 2.25, 2.5, 2.75, and 3 inches. Preferably, the weighted block 10 has a width w of about 2 inches. Such widths w allow the user to grip the weighted block 10 with natural grip formation, which can prevent unnecessary strain from being put on the hand while using and training with the weighted block 10. Other widths may be suitable, for example, if the weighted block 10 is being designed for use with individuals having smaller or larger than average hand sizes.

The weighted block 10 can have a height h of about 3.5 inches to about 5.5 inches, about 4 inches to about 5 inches, and/or about 4.5 inches to about 5.5 inches. Other suitable heights h include, about 3.5, 3.75, 4, 4.25, 4.5, 4.75, 5, 5.25, and 5.5 inches. The weighted block 10 should have sufficient height such that during use, the fingers of the user can remain straight and rest along the side gripping surfaces 16, 18. For example, the weighted block 10 can have a height h and width w such that the user's middle finger and thumb extend at least 50%, at least 60%, at least 70%, and/or at least 75% of the height h of the block.

The weighted block 10 should have a length sufficient to allow a user having an averaged sized hand to comfortably fit all of the fingers across the length of the weighted block 10, with sufficient spacing between the fingers to allow for a natural grip formation. For example, the weighted block 10 can have a length l of at least 4.5 inches, at least 5 inches, and/or at least 5.5 inches. Suitable lengths l, include, for example, about 4.5, 5, 5.25, 5.5, 5.75, 6, 6.25, 6.5, 6.75, 7, 7.25, 7.5, 7.75, 8, 8.25, 8.5, 8.75, 9, 9.25, 9.5, 9.75, and 10 inches.

The outer casing 12 can be formed of any suitable material that is sufficiently rigid so as not to flex or bend when the block is gripped by the user. For example, the outer casing 12 can be formed of a metal or a rigid plastic material. The outer casing 12 can be painted, have a surface texture, and/or have any suitable exterior surface treatment. Such surface treatments include treatments that can enhance the durability of the weighted block 10, for example, by preventing scratching of the block. The surface texture can, for example, enhance the friction of the surface of the weighted block 10 to make the weighted block 10 easier to handle without dropping the weighted block 10. For example, a plastic coating can be applied to the outer casing to provide an enhanced friction coating. One suitable surface coating is LINE-X (LINE-X Protective Coatings, AL)

Typically, the outer casing 12 has a hollow interior 22 in which the one or more weighted plates 24 are disposed. Referring to FIGS. 2 and 3, the weighted block 10 generally includes one or more weighted plates 24 disposed in an interior 22 of the outer casing 12. The weighted plates 24 can be disposed above the bottom surface 20 of the outer casing 12. In some embodiments, the weighted plates 24 can be disposed on (i.e., rest directly on) the interior of the bottom surface 20. The weighted plates 24 can have a size and shape that substantially corresponds to the size and shape of the interior 22 of the outer casing 12 so as to substantially equally distribute the weight of the plate across the entire length and width of the weighted block 10. In embodiments where more than one weighted plate 24 is included in the weighted block 10, the weighted plates 24 can be stacked on top of one another, or received by slots (not shown) in the outer casing 12, as described below.

The weighted plates 24 can be formed of any suitable material. For example, the weighted plates 24 can be formed of a metal. The plates can also be provided in any suitable mass increments so as to provide the total overall desired mass to the weighted block 10 depending on the user's gripping strength. For example, the weighted block 10 can have a total mass of about 1 lb to about 40 lbs, about 2 lbs to about 40 lbs, about 2.5 lbs to about 40 lbs, about 5 lbs to about 35 lbs, about 10 lbs to about 20 lbs, and/or about 15 lbs to about 20 lbs. Other suitable total masses include about 1, 1.25, 1.5, 1.75, 2, 2.25, 2.5, 2.75, 3, 3.25, 3.5, 3.75, 4, 4.25, 4.5, 4.75, 5, 5.25, 5.5, 5.75, 6, 6.25, 6.5, 6.75, 7, 7.25, 7.5, 7.75, 8, 8.25, 8.5, 8.75, 9, 9.25, 9.5, 9.75, 10, 10.5, 11, 11.5, 12, 12.5, 13, 13.5, 14, 14.5, 15, 15.5, 16, 16.5, 17, 17.5, 18, 18.5, 19, 19.5, 20, 21, 22, 23, 24, 25, 26, 27, 28, 29, 30, 31, 32, 33, 34, 35, 36, 37, 38, 39, 40 lbs.

The weighted block 10 can be formed, for example, using hollow tubing as the outer casing 12. The one or more weighted plates 24 can be disposed and optionally attached at or near the bottom surface 20 of the hollow tubing. Optionally, the tubing can then be capped on both ends to form the outer casing 12. The caps can be formed, for example, of the same material as the hollow tubing. In some embodiments, one or both of the ends can remain uncapped (open). For example, the hollow tubing and the weighted plates 24 can be formed of a metal, and the weighted plates 24 can be welded to the interior 22 of the outer tubing. Any other methods of inserting plates into an outer casing 12 having at least a partially hollow interior can be used. On the other hand, the outer casing 12 can be provided with one or more open regions other than the end region. The plates can be arranged and adhered near the bottom surface 20 of the outer casing 12 through the open region. The open region can be sealed or can remain open. If sealed, the open region can be sealed in any suitable way, for example, by capping it with a cap formed of the same material as the outer casing 12 with the open end. Other methods of forming the weighted block 10 include forming the outer casing 12 of individual walls about or around the weighted plates 24.

The weighted plates 24 can be coupled to the interior 22 of the outer casing 12, for example, by a mechanical fastener, an adhesive, a welded connection, a snap fit, and the like. Alternatively, the weighted plates 24 can be releasably received in slots (not shown) disposed in the interior 22. For example, the weighted plates 24 can be attached to the outer casing 12 at weld points 26 disposed along the perimeter of the weighted plates 24. Alternatively, adhesives can be used to attach the weighted plates 24 to the interior surface of the outer casing 12. The outer casing 12 can also be provided with one or more ledges and/or slots along the perimeter surfaces of the interior 22 of the outer casing 12, and the weighted plates 24 can rest upon and/or be adhered to the one or more ledges and/or slots. In one embodiment, the plates can rest directly upon the interior of the bottom surface 20 of the outer casing 12.

In an embodiment, the weighted plates 24 can be removably disposed in the interior 22 of the outer casing 12. Additionally, at least one of the surfaces of the outer casing can be openable or removable to allow access to the interior 22 of the outer casing 12. For example, the surface can be partially attached to the outer casing 12 such that the surface can be pulled away from the outer casing 12 to allow access to the interior 22 of the outer casing 12. Alternatively, the surface can be completely removable from and reattachable to the outer casing 12. For example, one or both of the end surfaces 32, 34 of the outer casing 12 can be openable or removable. For example, one or both of the ends surfaces 32, 34 can be partially attached to the first or second side gripping surface 16, 18 or to the top or bottom surface 14, 20 such that the end surface can be pulled away from the outer casing 12 to allow access to the interior 22 of the outer casing. In another embodiment, one or both of the end surfaces 32, 34 can be omitted from the outer casing 12 such that the interior 22 of the outer casing remains exposed through one of the end sides.

The total mass of the weighted block 10 can be adjusted by removing and/or adding weighted plates 24 to the weighted block 10 through the openable or removable surface. For example, the total mass of the weighted block 10 can be increased by adding additional weighted plates 24 to the interior of the outer casing 12. For example, weighted plates 24 can be added to the interior 22 of the outer casing 12 in a stacked configuration. Alternatively, or additionally, the total mass of the weighted block 10 can be increased by replacing an existing weighted plate 24 in the weighted block 10 with a weighted plate 24 having a higher mass. Similarly, the total mass of the weighted block 10 can be decreased by removing weighted plates 24 from the weighted block 10 through the openable or removable end surface and/or replacing an existing weighted plate 24 with a weighted plate having a lower mass.

Embodiments of the weighted block 10 having removable weighted plates 24 advantageously allow the weighted block 10 to be customized for use by a variety of different users having varying grip strengths. Additionally, the customization of the mass of the weighted block 10 allows a user to increase the mass of the weighted block 10 as their grip strength improves with continued use of the weighted block 10. Thus, a weighted block 10 having a customizable mass beneficially eliminates the need to purchase and/or store multiple weighted blocks 10 having various incremental masses.

Referring again to FIG. 1, to assist the user in maintaining a secure grip on the weighted block 10 during use, the outer casing 12 can include one or more friction enhancing surfaces 28 disposed on one or both of the side gripping surfaces 16, 18 of the weighted block 10. For example, the friction enhancing surface 28 can provide a rough or grooved friction surface. The friction enhancing surface 28 can be provided by the outer casing 12 material directly or can be provided by adhering a friction enhancing material to one or both of the side gripping surfaces 16, 18 of the outer casing 12. Any suitable friction enhancing material can be used for the friction enhancing surface 28. For example, the friction enhancing material can be a plastic material adhered to the side gripping surfaces 16, 18 of the outer casing 12 using an adhesive. As another example, the friction enhancing material can be grip tape, which is commonly used to provide an anti-skid surface on stairs. The friction enhancing surface 28 can be disposed across the entire side gripping surface 16, 18 or on a portion of the side gripping surface 16, 18.

The side gripping surfaces 16, 18 of the outer casing 12 and/or the friction enhancing surface 28 can further include indicia 30 to aid the user in properly positioning their hand for use of the weighted block 10. For example, the indicia 30 can include an outline of a hand gripping the apparatus, with four fingers being disposed on one side gripping surface 16 and a thumb, aligned with the middle finger, being disposed on the opposed side gripping surface 18. The indicia 30 can include, for example, a line on one or both of the side gripping surfaces 16, 18 providing an indication of the minimum distance the user's middle finger and/or thumb should extend down the height of the weighted block 10.

A Weighted Block Set

In accordance with an embodiment of the disclosure, a weighted block set can include multiple weighted blocks 10 each having incrementally different total masses. For example, the weighted block set can include weighted blocks 10 having total masses of 1.25 lbs, 2.5 lbs, 3.75 lbs, 5 lbs, 6.25 lbs, 7.5 lbs, 8.75 lbs, 10 lbs, 12.5 lbs, 15 lbs, 17.5 lbs, 20 lbs, 22.5 lbs, 25 lbs, 27 lbs, 30 lbs, 32.5 lbs, 35 lbs, 37.5 lbs, and 40 lbs. Any suitable number of weighted blocks 10 having any suitable incremental values of total mass can be included in the weighted block set. The weighted blocks 10 of the weighted block set can include a completely sealed casing such that the total mass of the weighted blocks 10 is not adjustable. Such a weighted block set may be advantageous for high volume use of the weighted block set, such as with traveling professional sports teams and in athletic clubs. Such non-adjustable weighted blocks 10 set can be more durable in heavy usage settings.

In accordance with another embodiment of the disclosure, a weighted block set can include one or more weighted blocks 10 having adjustable total masses, as described above, and one or more weighted plates 24 for adjusting the total mass of the weighted blocks 10. The weighted plates 24 can be provided with the same or different masses to allow for incremental adjustment of the total mass of the weighted block 10. Such a set may be advantageous for home usage, where storage space for multiple weighted blocks 10 may be limited.

Method of Increasing Grip Strength

Referring to FIG. 4, in accordance with an embodiment of the disclosure a method of increasing grip strength generally includes gripping the weighted block 10 with one hand such that the fingers are disposed on one side surface 16 of the weighted block 10 and the thumb is disposed on the opposed side surface 18. Preferably, the weighted block 10 is gripped such that at least a portion of the palm of the user's hand overlies the top surface 14. The weighted block 10 is also preferably gripped such that the middle finger and the thumb of the user substantially align with one another on opposite sides of the weighted block 10. This grip advantageously forces the fourth (ring) and fifth (little or pinky) fingers to work with equal pressure as the index and middle fingers. In conventional exercises, the fourth and fifth fingers generally work 70% less than the index and middle fingers. Thus, the method in accordance with embodiments of the disclosure can allow for even and balanced strengthening of the entire hand, including the fourth and fifth fingers.

Once properly gripped, the weighted block 10 is lowered along the side of the user. The weighted block 10 is lowered such that the user's arm is completely extended parallel to the side of the user's body, with the fingers and thumb of the hand gripping the weighted block 10 disposed parallel to the user's side. For example, the weighted block 10 can be gripped while the arm of the user is in a bent position and then the user can straighten their arm to lower the weighted block 10 along the side of the user such that the user's aim is completely extended parallel to the side of the user's body. Alternatively, if the weighted block 10 is gripped while being disposed on the floor, for example, the user can stand to a straightened position holding the weighted block 10 at their side such that their arm is extended parallel to their side and the fingers and thumb of the hand holding the weighted block 10 are parallel to the side of the user's body. In the extended position, the user bears the entire weight of the weighted block 10. The weighted block 10 is held in this position for a period of time. For example, the weighted block 10 can be held in the extended position for about 10 seconds to about 60 seconds, about 15 seconds to about 50 seconds, about 20 seconds to about 40 seconds, or about 25 seconds to about 30 seconds. Other suitable times can include, for example, about 10, 15, 20, 25, 30, 35, 40, 45, 50, 55, and 60 seconds.

The user can then return to a resting position, resting the weight of the block on another surface, for a period of time. In the resting position, the user no longer bears the weight of the weighted block 10. The resting period of time can be about 10 seconds to about 60 seconds, about 15 seconds to about 50 seconds, about 20 seconds to about 40 seconds, or about 25 seconds to about 30 seconds. Other suitable times can include, for example, about 10, 15, 20, 25, 30, 35, 40, 45, 50, 55, and 60 seconds. As an alternative to resting between repetitions, the method can be performed with the opposite hand. The method can be repeated any suitable number of times. For example, holding the weighted block 10 in the extended position can be repeated for one of both hands about 0 times to about 10 times, about 1 time to about 10 times, about 2 times to about 8 times, or about 4 times to about 6 times. Other suitable numbers of repetition include, for example, about 0, 1, 2, 3, 4, 5, 6, 7, 8, 9, and 10 times.

In accordance with another embodiment of the disclosure, the weighted block 10 can be used to develop the muscles that control supination and pronation of the forearm. A method of developing these muscles can include properly gripping the weighted block 10 with one hand such that the fingers and the thumb of the hand are disposed on the first and second side gripping surfaces, respectively, as described above. The method is performed with the user positioned face down with their body angled at a 45° to 90° angle with respect to the standing position. The user's lowers the hand gripping the weighted block 10 and extends the arm such that it hangs outwardly and freely from their body generally in the direction of the floor. The palm of the user's hand holding the weighted block 10 faces downward. While bearing the weight of the weighted block 10, the user rotates their arm outwardly, such that the palm of the hand holding the weighted block 10 faces forward (supination), and then rotates their arm inwardly, such that the palm of the hand holding the weighted block 10 faces backward (pronation). An exercise set of the arm rotation (outwardly and inwardly) can include any suitable number of repetitions. For example, the set can include about 10 to about 30 repetitions, about 12 to about 28 repetitions, about 15 to about 20 repetitions, and/or about 14 to about 18 repetitions. Other suitable numbers of repetitions include about 10, 12, 14, 16, 18, 20, 22, 24, 26, 28, and 30 repetitions. Any suitable number of sets can be performed. For example, about 1 to about 10 sets, about 2 to about 8 sets, about 4 to about 6 sets, and/or about 3 to about 10 sets can be performed. Other suitable number of sets can include, for example, about 1, 2, 3, 4, 5, 6, 7, 8, 9, and 10 sets.

A resting period can be interposed between performance of the sets. The resting period can include releasing the grip on the weighted block 10 and/or resting the weighted block 10 on a surface so that the user no longer bears the weight of the weighted block 10. The resting period can be for any suitable amount of time. For example, the resting period of time can be about 10 seconds to about 60 seconds, about 15 seconds to about 50 seconds, about 20 seconds to about 40 seconds, and/or about 25 seconds to about 30 seconds. Other suitable times can include, for example, about 10, 15, 20, 25, 30, 35, 40, 45, 50, 55, and 60 seconds. As an alternative to resting between sets, the method can be performed with the opposite arm. The user can then rest, for example, after performance of the exercise with each arm. The resting period after performance of the exercise with both arms can be about 1 minute to about 5 minutes, about 2 minutes to about 4 minutes, and/or about 3 minutes to about 5 minutes. Other suitable times include, for example, about 1, 2, 3, 4, and 5 minutes. The above-described method advantageously engages the entire chair of muscles from the fingers to the trapezoid, while targeting development of the muscles that control supination and pronation of the forearm.

Although the foregoing text is a detailed description of numerous different embodiments of a weighted block and method of using the same in accordance with the disclosure, the detailed description is to be construed as exemplary only and does not describe every possible embodiment in accordance with the disclosure. Consequently only such limitations as appear in the appended claims should be placed on the invention.

What is claimed:

1. A method of increasing grip strength, comprising:

providing a weighted block having first and second side gripping surfaces;

gripping with one hand the weighted block such that the fingers and the thumb of the hand are disposed on the first and second side gripping surfaces, respectively, the fingers and the thumb extending substantially straight along the first and second side surfaces, respectively; and holding the weighted block such that an arm connected to the hand is extended substantially straight along a side of a user and the fingers and thumb are disposed substantially parallel to the side of the user, wherein the weighted block has a width of about 1.75 inches to 3 inches, wherein the weighted block further comprises a top surface extending between and connecting the first and second side gripping surfaces, a bottom surface disposed opposite the top surface, said bottom surface extending between and connecting the first and second side gripping surfaces, two end surfaces extending between and connecting the top and bottom surfaces and extending between and connecting the two side gripping surfaces, and one or more weighted plates disposed in an interior of the weighted block adjacent the bottom surface, wherein the weighted block is held such that at least a portion of a palm of the user's hand overlies the top surface, and wherein at least one of the surfaces of the outer casing is openable or removable to allow access to the interior to allow for incremental adjustment of the total mass of the weighted block.

2. The method of claim 1, further comprising holding the weighted block with the hand extended substantially straight along the side of the user and the fingers and thumb disposed substantially parallel to the side of the user for about 10 seconds to about 60 seconds.

3. The method of claim 1, further comprising resting the weighted block on a surface for a resting time period and repeating the holding step with the hand extended substantially straight along the side of the user and the fingers and thumb disposed substantially parallel to the side of the user after the resting time period.

4. The method of claim 1, comprising gripping the weighted block while the arm of the user is in a bent position, the method further comprising extending the arm to lower the weighted block along the side of the user prior to holding the weighted block with the hand extended substantially straight along the side of the user and the fingers and thumb are disposed substantially parallel to the side of the user.

5. The method of claim 1, wherein each of the middle finger and the thumb extend at least 50% of a height of the weighted block when the weighted block is held with the hand extended substantially straight along the side of the user and the fingers and thumb disposed substantially parallel to the side of the user.

6. The method of claim 1, wherein the middle finger is substantially aligned with the thumb.

7. The method of claim 1, wherein the weighted block has a height of about 3.5 inches to about 5.5 inches.

8. The method of claim 1, wherein the weighted block has a length of at least 4.5 inches.

9. The method of claim 1, wherein the weighted block has a width of about 2 inches.

10. The method of claim 1, wherein the weighted block includes a friction surface disposed on one or both of the first and second side gripping surfaces.

11. The method of claim 1, wherein the weighted block has a mass of about 1 pound to about 40 pounds.

12. The method of claim 1, wherein the user is in a standing position.

13. A weighted block for improving grip strength of a user, comprising:

an outer casing comprising:

first and second side gripping surfaces; and top and bottom surfaces extending between and connecting the first and second side gripping surfaces; and one or more weighted plates disposed in an inner portion of the outer casing, said weighted plates being disposed on or above the bottom surface, wherein the outer casing has a width of about 1.75 inches to about 3 inches, wherein the outer casing further comprises two end surfaces extending between and connecting the top and bottom surfaces and extending between and connecting the two side gripping surfaces, and one or more weighted plates disposed in an interior of the outer casing adjacent the bottom surface, wherein at least one of the surfaces of the outer casing is openable or removable to allow access to the interior to allow for incremental adjustment of the total mass of the weighted block.

14. The weighted block of claim 13, wherein the outer casing has a height of about 3.5 inches to about 5.5 inches.

15. The weighted block of claim 13, wherein the outer casing has a length of at least 4.5 inches.

16. The weighted block of claim 13, wherein the outer casing has a width of about 2 inches.

17. The weighted block of claim 13, wherein the top surface has squared edges connecting the top surface to the first and second side gripping surfaces.

18. The weighted block of claim 13, wherein the one or more weighted plates have a length and a width that are substantially the same as the length and the width of the bottom surface.

19. The weighted block of claim 13, comprising two or more weighted plates arranged in a stacked configuration.

20. The weighted block of claim 13, wherein at least one of the first and second end surfaces is capable of being opened or removably attached to the outer casing.

21. The weighted block of claim 20, wherein the weighted plates are removably coupled to the inner portion of the outer casing.

22. The weighted block of claim 13, wherein the weighted block has a height and a width such that the middle finger and thumb each extend at least 50% of a height of the outer casing.

23. The weighted block of claim 13, wherein the weighted block has a total mass of about 1 pound to about 40 pounds.

24. The weighted block of claim 13, further comprising friction surfaces disposed on one or both of the first and second side gripping surfaces.

25. The weighted block of claim 13, further comprising indicia disposed on one or both of the first and second side gripping surfaces, wherein the indicia provide a guide for gripping and holding the weighted block such that the fingers and the thumb of a user's hand are disposed on the first and second side gripping surfaces, respectively, and extend substantially straight along the first and second side surfaces, respectively.

26. A weighted block for improving grip strength of a user, comprising an outer casing comprising:

first and second side gripping surfaces;

top and bottom surfaces extending between and connecting the first and second side gripping surfaces; and first and second end surfaces extending between and connecting the top and bottom surfaces and extending between and connecting the first and second side gripping surfaces, at least one the surfaces being adapted to open and thereby allow access to an inner portion of the outer casing; and one or more weighted plates removably disposed in the inner portion of the outer casing, said weighted plates being disposed on or above the bottom surface.

27. The method of claim 1, further comprising accessing the interior and adjusting the total mass of the weighted block.

* * * * *